US008408879B2

(12) United States Patent
Kidd et al.

(10) Patent No.: US 8,408,879 B2
(45) Date of Patent: Apr. 2, 2013

(54) COMPRESSOR ASSEMBLY INCLUDING SEPARATOR AND EJECTOR PUMP

(75) Inventors: H. Allan Kidd, Shinglehouse, PA (US); William C. Maier, Almond, NC (US); Gocha Chochua, Sugar Land, TX (US)

(73) Assignee: Dresser-Rand Company, Olean, NY (US)

( * ) Notice: Subject to any disclaimer, the term of this patent is extended or adjusted under 35 U.S.C. 154(b) by 292 days.

(21) Appl. No.: 12/919,977

(22) PCT Filed: Mar. 5, 2009

(86) PCT No.: PCT/US2009/036142

§ 371 (c)(1), (2), (4) Date: Sep. 13, 2010

(87) PCT Pub. No.: WO2009/111616

PCT Pub. Date: Sep. 11, 2009

(65) Prior Publication Data

US 2011/0017307 A1 Jan. 27, 2011

Related U.S. Application Data

(60) Provisional application No. 61/068,385, filed on Mar. 5, 2008.

(51) Int. Cl.
*F04B 23/08* (2006.01)
*F04F 5/24* (2006.01)

(52) U.S. Cl. ..... 417/84; 417/158; 417/203; 417/423.1; 137/565.22; 137/565.32; 137/565.33

(58) Field of Classification Search ..... 417/53, 417/76, 84, 158, 118, 201, 203, 205, 251, 417/423.1; 96/155, 204, 206, 208; 137/565.22, 137/565.29, 565.33, 565.32; 95/241, 254
See application file for complete search history.

(56) References Cited

U.S. PATENT DOCUMENTS 815,812 A 3/1906 Gow
1,057,613 A 4/1913 Baldwin
(Continued)

FOREIGN PATENT DOCUMENTS

CA 2647511 10/2007
EP 301285 10/1991
(Continued)

OTHER PUBLICATIONS

Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

(Continued)

*Primary Examiner* — Peter J Bertheaud
*Assistant Examiner* — Bryan Lettman
(74) *Attorney, Agent, or Firm* — Edmonds & Nolte, PC

(57) ABSTRACT

A fluid processing device for processing a multiphase fluid stream including a mixture of at least a gas and a liquid is disclosed. The fluid processing device may include at least one separator configured to separate the fluid stream into a liquid portion and a gaseous portion and deposit the liquid portion into a liquid reservoir. The gaseous portion may be directed to a compressor configured to pressurize and discharge a pressurized gas into a fluid discharge line. A portion of the pressurized gas may be further pressurized and directed to at least one ejector pump fluidly coupled to the liquid reservoir and configured to draw in liquid and discharge pressurized liquid into the fluid discharge line.

23 Claims, 6 Drawing Sheets

U.S. PATENT DOCUMENTS

| | | | | |
|---|---|---|---|---|
| 1,061,656 | A | | 5/1913 | Black |
| 1,480,775 | A | | 1/1924 | Marien |
| 1,622,768 | A | | 3/1927 | Cook et al. |
| 1,642,454 | A | | 9/1927 | Malmstrom |
| 2,006,244 | A | | 6/1935 | Kopsa |
| 2,300,766 | A | | 11/1942 | Baumann |
| 2,328,031 | A | | 8/1943 | Risley |
| 2,345,437 | A | | 3/1944 | Tinker |
| 2,602,462 | A | | 7/1952 | Barrett |
| 2,811,303 | A | | 10/1957 | Ault et al. |
| 2,836,117 | A | | 5/1958 | Lankford |
| 2,868,565 | A | | 1/1959 | Suderow |
| 2,897,917 | A | | 8/1959 | Hunter |
| 2,932,360 | A | | 4/1960 | Hungate |
| 2,954,841 | A | | 10/1960 | Reistle |
| 3,044,657 | A | | 7/1962 | Horton |
| 3,191,364 | A | | 6/1965 | Sylvan |
| 3,198,214 | A | | 8/1965 | Lorenz |
| 3,204,696 | A | | 9/1965 | De Priester et al. |
| 3,213,794 | A | | 10/1965 | Adams |
| 3,220,245 | A | | 11/1965 | Van Winkle |
| 3,273,325 | A | | 9/1966 | Gerhold |
| 3,352,577 | A | | 11/1967 | Medney |
| 3,366,061 | A | * | 1/1968 | Adams ..... 137/154 |
| 3,395,511 | A | | 8/1968 | Akerman |
| 3,420,434 | A | | 1/1969 | Swearingen |
| 3,431,747 | A | | 3/1969 | Hashemi et al. |
| 3,454,163 | A | | 7/1969 | Read |
| 3,486,297 | A | * | 12/1969 | Eisinga et al. ..... 95/22 |
| 3,487,432 | A | | 12/1969 | Jenson |
| 3,490,209 | A | | 1/1970 | Fernandes et al. |
| 3,500,614 | A | | 3/1970 | Soo |
| 3,578,342 | A | | 5/1971 | Welch |
| 3,628,812 | A | | 12/1971 | Larraide et al. |
| 3,672,733 | A | | 6/1972 | Arsenius et al. |
| 3,814,486 | A | | 6/1974 | Schurger |
| 3,829,179 | A | | 8/1974 | Kurita et al. |
| 3,915,673 | A | | 10/1975 | Tamai et al. |
| 3,975,123 | A | | 8/1976 | Schibbye |
| 4,033,647 | A | | 7/1977 | Beavers |
| 4,059,364 | A | | 11/1977 | Anderson et al. |
| 4,078,809 | A | | 3/1978 | Garrick et al. |
| 4,087,261 | A | | 5/1978 | Hays |
| 4,103,899 | A | | 8/1978 | Turner |
| 4,112,687 | A | | 9/1978 | Dixon |
| 4,117,359 | A | | 9/1978 | Wehde |
| 4,135,542 | A | | 1/1979 | Chisholm |
| 4,141,283 | A | | 2/1979 | Swanson et al. |
| 4,146,261 | A | | 3/1979 | Edmaier et al. |
| 4,165,622 | A | | 8/1979 | Brown, Jr. |
| 4,174,925 | A | | 11/1979 | Pfenning et al. |
| 4,182,480 | A | | 1/1980 | Theyse et al. |
| 4,197,990 | A | | 4/1980 | Carberg et al. |
| 4,205,927 | A | | 6/1980 | Simmons |
| 4,227,373 | A | | 10/1980 | Amend et al. |
| 4,258,551 | A | | 3/1981 | Ritzi |
| 4,259,045 | A | | 3/1981 | Teruyama |
| 4,278,200 | A | | 7/1981 | Gunnewig |
| 4,298,311 | A | | 11/1981 | Ritzi |
| 4,333,748 | A | | 6/1982 | Erickson |
| 4,334,592 | A | | 6/1982 | Fair |
| 4,336,693 | A | | 6/1982 | Hays et al. |
| 4,339,923 | A | | 7/1982 | Hays et al. |
| 4,347,900 | A | | 9/1982 | Barrington |
| 4,363,608 | A | | 12/1982 | Mulders |
| 4,374,583 | A | | 2/1983 | Barrington |
| 4,375,975 | A | | 3/1983 | McNicholas |
| 4,382,804 | A | | 5/1983 | Mellor |
| 4,384,724 | A | | 5/1983 | Derman et al. |
| 4,391,102 | A | | 7/1983 | Studhalter et al. |
| 4,396,361 | A | | 8/1983 | Fraser |
| 4,432,470 | A | | 2/1984 | Sopha |
| 4,438,638 | A | | 3/1984 | Hays et al. |
| 4,441,322 | A | | 4/1984 | Ritzi |
| 4,442,925 | A | | 4/1984 | Fukushima et al. |
| 4,453,893 | A | | 6/1984 | Hutmaker |
| 4,463,567 | A | | 8/1984 | Amend et al. |
| 4,468,234 | A | | 8/1984 | McNicholas |
| 4,471,795 | A | | 9/1984 | Linhardt |
| 4,477,223 | A | | 10/1984 | Giroux |
| 4,502,839 | A | | 3/1985 | Maddox et al. |
| 4,511,309 | A | | 4/1985 | Maddox |
| 4,531,888 | A | | 7/1985 | Buchelt |
| 4,536,134 | A | | 8/1985 | Huiber |
| 4,541,531 | A | | 9/1985 | Brule |
| 4,541,607 | A | | 9/1985 | Hotger |
| 4,573,527 | A | | 3/1986 | McDonough |
| 4,574,815 | A | | 3/1986 | West et al. |
| 4,648,806 | A | | 3/1987 | Alexander |
| 4,687,017 | A | | 8/1987 | Danko et al. |
| 4,737,081 | A | | 4/1988 | Nakajima et al. |
| 4,752,185 | A | | 6/1988 | Butler et al. |
| 4,807,664 | A | | 2/1989 | Wilson et al. |
| 4,813,495 | A | | 3/1989 | Leach |
| 4,821,737 | A | | 4/1989 | Nelson |
| 4,826,403 | A | | 5/1989 | Catlow |
| 4,830,331 | A | | 5/1989 | Vindum |
| 4,832,709 | A | | 5/1989 | Nagyszalanczy |
| 4,904,284 | A | | 2/1990 | Hanabusa |
| 4,984,830 | A | | 1/1991 | Saunders |
| 5,007,328 | A | | 4/1991 | Otteman |
| 5,024,585 | A | | 6/1991 | Kralovec |
| 5,043,617 | A | | 8/1991 | Rostron |
| 5,044,701 | A | | 9/1991 | Watanabe et al. |
| 5,045,046 | A | | 9/1991 | Bond |
| 5,054,995 | A | | 10/1991 | Kaseley et al. |
| 5,064,452 | A | | 11/1991 | Yano et al. |
| 5,080,137 | A | | 1/1992 | Adams |
| 5,190,440 | A | | 3/1993 | Maier et al. |
| 5,202,024 | A | | 4/1993 | Andersson et al. |
| 5,202,026 | A | | 4/1993 | Lema |
| 5,203,891 | A | | 4/1993 | Lema |
| 5,207,810 | A | | 5/1993 | Sheth |
| 5,211,427 | A | | 5/1993 | Washizu |
| 5,246,346 | A | | 9/1993 | Schiesser |
| 5,285,123 | A | | 2/1994 | Kataoka et al. |
| 5,306,051 | A | | 4/1994 | Loker et al. |
| 5,337,779 | A | | 8/1994 | Fukuhara |
| 5,378,121 | A | | 1/1995 | Hackett |
| 5,385,446 | A | | 1/1995 | Hays |
| 5,421,708 | A | | 6/1995 | Utter |
| 5,443,581 | A | | 8/1995 | Malone |
| 5,484,521 | A | | 1/1996 | Kramer |
| 5,496,394 | A | | 3/1996 | Nied |
| 5,500,039 | A | | 3/1996 | Mori et al. |
| 5,525,034 | A | | 6/1996 | Hays |
| 5,525,146 | A | | 6/1996 | Straub |
| 5,531,811 | A | | 7/1996 | Kloberdanz |
| 5,538,259 | A | | 7/1996 | Uhrner et al. |
| 5,542,831 | A | | 8/1996 | Scarfone |
| 5,575,309 | A | | 11/1996 | Connell |
| 5,585,000 | A | | 12/1996 | Sassi |
| 5,605,172 | A | | 2/1997 | Schubert et al. |
| 5,628,623 | A | | 5/1997 | Skaggs |
| 5,634,492 | A | | 6/1997 | Steinruck et al. |
| 5,640,472 | A | | 6/1997 | Meinzer et al. |
| 5,641,280 | A | | 6/1997 | Timuska |
| 5,653,347 | A | | 8/1997 | Larsson |
| 5,664,420 | A | | 9/1997 | Hays |
| 5,682,759 | A | | 11/1997 | Hays |
| 5,683,235 | A | | 11/1997 | Welch |
| 5,685,691 | A | | 11/1997 | Hays |
| 5,687,249 | A | | 11/1997 | Kato |
| 5,693,125 | A | | 12/1997 | Dean |
| 5,703,424 | A | | 12/1997 | Dorman |
| 5,709,528 | A | | 1/1998 | Hablanian |
| 5,713,720 | A | | 2/1998 | Barhoum |
| 5,720,799 | A | | 2/1998 | Hays |
| 5,750,040 | A | | 5/1998 | Hays |
| 5,775,882 | A | | 7/1998 | Kiyokawa et al. |
| 5,779,619 | A | | 7/1998 | Borgstrom et al. |
| 5,795,135 | A | | 8/1998 | Nyilas et al. |
| 5,800,092 | A | | 9/1998 | Nill et al. |
| 5,848,616 | A | | 12/1998 | Vogel et al. |
| 5,850,857 | A | | 12/1998 | Simpson |
| 5,853,585 | A | | 12/1998 | Nesseth |
| 5,863,023 | A | | 1/1999 | Evans et al. |

5,899,435 A 5/1999 Mitsch et al.
5,935,053 A 8/1999 Strid
5,938,803 A 8/1999 Dries
5,938,819 A 8/1999 Seery
5,946,915 A 9/1999 Hays
5,951,066 A 9/1999 Lane et al.
5,965,022 A 10/1999 Gould
5,967,746 A 10/1999 Hagi et al.
5,971,702 A 10/1999 Afton et al.
5,971,907 A 10/1999 Johannemann et al.
5,980,218 A 11/1999 Takahashi et al.
5,988,524 A 11/1999 Odajima et al.
6,035,934 A 3/2000 Stevenson et al.
6,059,539 A 5/2000 Nyilas et al.
6,068,447 A 5/2000 Foege
6,090,174 A 7/2000 Douma et al.
6,090,299 A 7/2000 Hays et al.
6,113,675 A 9/2000 Branstetter
6,122,915 A 9/2000 Hays
6,123,363 A 9/2000 Burgard et al.
6,145,844 A 11/2000 Waggott
6,149,825 A 11/2000 Gargas
6,151,881 A 11/2000 Ai et al.
6,196,962 B1 3/2001 Purvey et al.
6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Carew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
8,257,055 B2 * 9/2012 Beg et al. ..... 417/87
2001/0007283 A1 7/2001 Johal et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballott et al.
2006/0275160 A1 12/2006 Leu et al.
2007/0029091 A1 2/2007 Stinessen et al.
2007/0036646 A1 2/2007 Nguyen et al.
2007/0051245 A1 3/2007 Yun
2007/0062374 A1 3/2007 Kolle

| | | | | |
|---|---|---|---|---|
| 2007/0065317 | A1 | 3/2007 | Stock | |
| 2007/0084340 | A1 | 4/2007 | Dou et al. | |
| 2007/0140870 | A1 | 6/2007 | Fukanuma et al. | |
| 2007/0151922 | A1 | 7/2007 | Mian | |
| 2007/0163215 | A1 | 7/2007 | Lagerstadt | |
| 2007/0172363 | A1 | 7/2007 | Laboube et al. | |
| 2007/0196215 | A1 | 8/2007 | Frosini et al. | |
| 2007/0227969 | A1* | 10/2007 | Dehaene et al. | 210/603 |
| 2007/0294986 | A1 | 12/2007 | Beetz | |
| 2008/0031732 | A1 | 2/2008 | Peer et al. | |
| 2008/0039732 | A9 | 2/2008 | Bowman | |
| 2008/0246281 | A1 | 10/2008 | Agrawal et al. | |
| 2008/0315812 | A1 | 12/2008 | Balboul | |
| 2009/0013658 | A1 | 1/2009 | Borgstrom et al. | |
| 2009/0015012 | A1 | 1/2009 | Metzler et al. | |
| 2009/0025562 | A1 | 1/2009 | Hallgren et al. | |
| 2009/0025563 | A1 | 1/2009 | Borgstrom et al. | |
| 2009/0151928 | A1 | 6/2009 | Lawson | |
| 2009/0159523 | A1 | 6/2009 | McCutchen | |
| 2009/0169407 | A1 | 7/2009 | Yun | |
| 2009/0173095 | A1 | 7/2009 | Bhatia et al. | |
| 2009/0266231 | A1 | 10/2009 | Franzen et al. | |
| 2009/0304496 | A1 | 12/2009 | Maier | |
| 2009/0321343 | A1 | 12/2009 | Maier | |
| 2009/0324391 | A1 | 12/2009 | Maier | |
| 2010/0007133 | A1 | 1/2010 | Maier | |
| 2010/0021292 | A1 | 1/2010 | Maier et al. | |
| 2010/0038309 | A1 | 2/2010 | Maier | |
| 2010/0043288 | A1 | 2/2010 | Wallace | |
| 2010/0043364 | A1 | 2/2010 | Curien | |
| 2010/0044966 | A1 | 2/2010 | Majot et al. | |
| 2010/0072121 | A1 | 3/2010 | Maier | |
| 2010/0074768 | A1 | 3/2010 | Maier | |
| 2010/0083690 | A1 | 4/2010 | Sato et al. | |
| 2010/0090087 | A1 | 4/2010 | Maier | |
| 2010/0098525 | A1* | 4/2010 | Guelich | 415/13 |
| 2010/0143172 | A1 | 6/2010 | Sato et al. | |
| 2010/0163232 | A1 | 7/2010 | Koll | |
| 2010/0183438 | A1 | 7/2010 | Maier et al. | |
| 2010/0239419 | A1 | 9/2010 | Maier et al. | |
| 2010/0239437 | A1 | 9/2010 | Maier | |
| 2010/0247299 | A1 | 9/2010 | Maier | |
| 2010/0257827 | A1 | 10/2010 | Lane et al. | |
| 2011/0017307 | A1 | 1/2011 | Kidd et al. | |
| 2011/0061536 | A1 | 3/2011 | Maier et al. | |

FOREIGN PATENT DOCUMENTS

| | | | |
|---|---|---|---|
| EP | 1582703 | | 10/2005 |
| EP | 2013479 | | 1/2009 |
| EP | 7838631.5 | | 12/2009 |
| GB | 2323639 | | 9/1998 |
| GB | 2337561 | | 11/1999 |
| JP | 54099206 | | 1/1978 |
| JP | 08 068501 | | 3/1996 |
| JP | 8-284961 | A | 11/1996 |
| JP | 2002 242699 | | 8/2002 |
| JP | 2004034017 | A | 2/2004 |
| JP | 3711028 | | 10/2005 |
| JP | 2005291202 | | 10/2005 |
| KR | 2009085521 | | 2/2008 |
| MX | 2008012579 | | 12/2008 |
| WO | 9524563 | | 9/1995 |
| WO | 0117096 | | 3/2001 |
| WO | 2007043889 | | 4/2007 |
| WO | 2007103248 | | 9/2007 |
| WO | 2007120506 | | 10/2007 |
| WO | 2008036221 | | 3/2008 |
| WO | 2008039446 | | 3/2008 |
| WO | 2008039491 | | 4/2008 |
| WO | 2008039731 | | 4/2008 |
| WO | 2008039732 | | 4/2008 |
| WO | 2008039733 | | 4/2008 |
| WO | 2008039734 | | 4/2008 |
| WO | 2008036394 | | 7/2008 |
| WO | 2009111616 | | 9/2009 |
| WO | 2009158252 | | 12/2009 |
| WO | 2009158253 | | 12/2009 |
| WO | 2010083416 | | 7/2010 |
| WO | 2010083427 | | 7/2010 |
| WO | 2010107579 | | 9/2010 |
| WO | 2010110992 | | 9/2010 |
| WO | 2011034764 | | 3/2011 |

OTHER PUBLICATIONS

PCT/US2007/008149 International Preliminary Report on Patentability dated Sep. 30, 2008.
PCT/US2007/008149 International Search Report and Written Opinion dated Jul. 17, 2008.
PCT/US2007/020101 International Preliminary Report on Patentability dated Apr. 2, 2009.
PCT/US2007/020101 International Search Report dated Apr. 29, 2008.
PCT/US2007/020101 Written Opinion dated Mar. 19, 2009.
PCT/US2007/020471 International Preliminary Report on Patentability dated Apr. 2, 2009.
PCT/US2007/020471 International Search Report and Written Opinion dated Apr. 1, 2008.
PCT/US2007/020659 International Preliminary Report on Patentability dated Mar. 31, 2009.
PCT/US2007/020659 International Search Report and Written Opinion dated Sep. 17, 2008.
PCT/US2007/020768 International Preliminary Report on Patentability dated Mar. 31, 2009.
PCT/US2007/020768 International Search Report and Written Opinion dated Mar. 3, 2008.
PCT/US2007/079348 International Preliminary Report on Patentability dated Mar. 31, 2009.
PCT/US2007/079348 International Search Report dated Apr. 11, 2008.
PCT/US2007/079348 Written Opinion dated Jan. 25, 2008.
PCT/US2007/079349 International Preliminary Report on Patentability dated Mar. 31, 2009.
PCT/US2007/079349 International Search Report and Written Opinion dated Apr. 2, 2008.
PCT/US2007/079350 International Preliminary Report on Patentability dated Mar. 31, 2009.
PCT/US2007/079350 International Search Report dated Jul. 17, 2008.
PCT/US2007/079350 Written Opinion dated Mar. 25, 2009.
PCT/US2007/079352 International Preliminary Report on Patentability dated Mar. 31, 2009.
PCT/US2007/079352 International Search Report and Written Opinion dated Aug. 27, 2008.
PCT/US2009/036142 International Preliminary Report on Patentability dated Sep. 16, 2010.
PCT/US2009/036142 International Search Report dated Jan. 7, 2010.
PCT/US2009/036142 Written Opinion dated May 11, 2009.
PCT/US2009/047662 International Preliminary Report on Patentability dated Jan. 13, 2011.
PCT/US2009/047662 Written Opinion dated Aug. 20, 2009.
PCT/US2010/021199 International Search Report and Written Opinion dated Mar. 22, 2010.
PCT/US2010/021199 International Preliminary Report on Patentability dated Mar. 29, 2011.
PCT/US2010/021218 International Search Report and Written Opinion dated Mar. 23, 2010.
PCT/US2010/021218 International Report on Patentability dated Feb. 2, 2011.
PCT/US2010/025650 International Search Report and Written Opinion dated Apr. 22, 2010.
PCT/US2010/025650 International Report on Patentability dated Mar. 14, 2011.
PCT/US2010/025952 International Search Report and Written Opinion dated Apr. 12, 2010.
PCT/US2010/025952 International Report on Patentability dated Mar. 14, 2011.
PCT/US2009/047667 International Report on Patentability dated Jan. 13, 2011.
PCT/US2009/047667 Written Opinion dated Aug. 7, 2009.

PCT/US2009/047667 International Search Report dated Dec. 30, 2009.
Dresser-Rand, Inc. "High Pressure Air Compressor Model 13NL45," Oct. 28, 1991, 14 pages.

* cited by examiner

COMPRESSOR ASSEMBLY INCLUDING SEPARATOR AND EJECTOR PUMP

This application is a United States national phase application of co-pending international patent application number PCT/US2009/036142, filed Mar. 5, 2009, which claims the benefit of the filing date of U.S. provisional patent application No. 61/068,385, filed Mar. 5, 2008, the disclosures of which are incorporated herein by reference.

A variety of devices for handling fluid streams, such as separators, compressors, and pumps, are known. A separator basically functions to separate a fluid stream into different phases, such as into liquid and gaseous portions, and/or may be used to remove solid matter from a fluid stream. Compressors and pumps basically function to compress or pressurize gases and pressurize liquids, respectively, often for the purpose of transporting the fluid (e.g., within a pipeline). Typically, when a fluid stream is composed of both gaseous and liquid portions, the fluid stream must first be separated, and then the gaseous portions are directed into a compressor while the liquid portions are directed into a pump so as to be separately treated. Such liquid pumps generally include a rotary impeller powered by a separate driver or motor, and operate such that the fluid is accelerated by passing through the rotating impeller and then decelerated to increase the liquid pressure.

Typical compressor assemblies employ a separated conventional liquid pump (e.g., a centrifugal pump) to handle the separated liquid. Pumping the liquid with a centrifugal pump requires additional power input, thus reducing the overall efficiency of the compressor. What is needed is a single-motor compressor system designed to separate liquid from the process stream and compress the gas, wherein the liquid is pressurized and reintroduced to the pressurized gas stream at the same pressure.

SUMMARY OF THE INVENTION

Embodiments of the disclosure may provide a fluid processing device for processing a multiphase fluid stream having a mixture of at least a gas and a liquid. The fluid processing device may include at least one separator configured to separate the multiphase fluid stream into a substantially liquid portion and a substantially gaseous portion, a liquid reservoir having an inlet and an outlet, wherein the inlet is fluidly coupled to the at least one separator such that the substantially liquid portion flows into the liquid reservoir, a compressor having an inlet and an outlet, wherein the inlet of the compressor is fluidly coupled with an outlet of the at least one separator so as to receive and pressurize the substantially gaseous portion, thereby discharging a pressurized gas through the outlet of the compressor, an ejector pump fluidly coupled to both the compressor and the liquid reservoir, wherein the ejector pump receives a portion of the pressurized gas from the compressor to draw in a flow of the substantially liquid portion from the liquid reservoir and to discharge a combined stream of liquid and pressurized gas, and a fluid discharge line fluidly coupled to the compressor outlet and configured to receive both the pressurized gas from the compressor and the combined stream of liquid and pressurized gas from the ejector pump, thereby forming a pressurized multiphase fluid stream.

Embodiments of the disclosure may further provide a fluid processing device for processing a multiphase fluid stream having a mixture of at least a gas and a liquid. The fluid processing device may include a separator fluidly coupled to a multiphase fluid source and configured to separate the multiphase fluid stream into a substantially liquid portion and a substantially gaseous portion, a liquid reservoir having an inlet and an outlet, wherein the inlet is fluidly coupled to the first separator such that the substantially liquid portion flows into the liquid reservoir, a compressor having an inlet and an outlet, wherein the inlet of the compressor is fluidly coupled to the first separator to receive the substantially gaseous portion, the compressor being configured to pressurize the substantially gaseous portion and discharge a pressurized gas through the outlet of the compressor, a first ejector pump fluidly coupled to both the compressor and the liquid reservoir, wherein the first ejector pump is configured to receive a portion of the pressurized gas from the compressor to draw in a flow of the substantially liquid portion from the liquid reservoir and to discharge a first pressurized liquid, a second ejector pump fluidly coupled to both the compressor and the first ejector pump, wherein the second ejector pump is configured to receive a portion of the pressurized gas from the compressor to draw in the first pressurized liquid from the first ejector pump and to discharge a second pressurized liquid, and a fluid discharge line fluidly coupled to the outlet of the compressor and configured to receive both the pressurized gas from the compressor and the second pressurized liquid from the second ejector pump, wherein a pressurized multiphase fluid stream results.

Embodiments of the present disclosure may further provide a method of processing a multiphase fluid stream including a mixture of a gas and a liquid. The method may include the steps of separating the multiphase fluid stream into a substantially liquid portion and a substantially gaseous portion using a first separator, directing the substantially liquid portion to a liquid reservoir fluidly coupled to the first separator, pressurizing the substantially gaseous portion in a compressor having an inlet and an outlet, wherein the inlet of the compressor is fluidly coupled to the first separator, discharging a pressurized gas through the outlet of the compressor, directing a portion of the pressurized gas from the compressor to an ejector pump fluidly coupled to both the compressor and the liquid reservoir, drawing in a flow of the substantially liquid portion from the liquid reservoir into the ejector pump, discharging a pressurized liquid from the ejector pump, and receiving into a fluid discharge line both the pressurized gas from the compressor and the pressurized liquid from the ejector pump, wherein the fluid discharge line is fluidly coupled to both the compressor outlet and the ejector pump, thereby forming a pressurized multiphase fluid stream.

BRIEF DESCRIPTION OF THE SEVERAL VIEWS OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
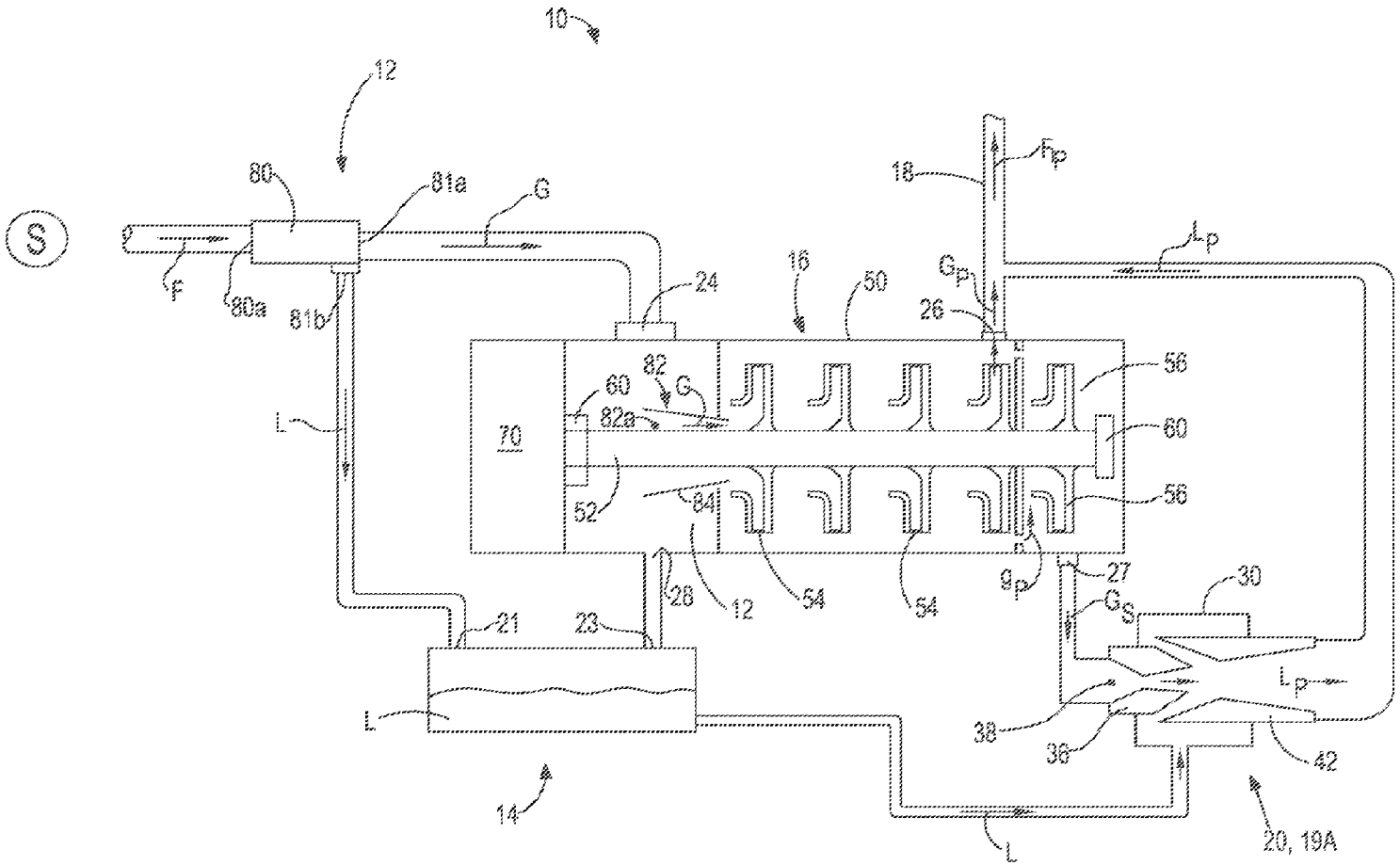
FIG. 1 is a schematic view of a fluid processing device according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Figure 2:
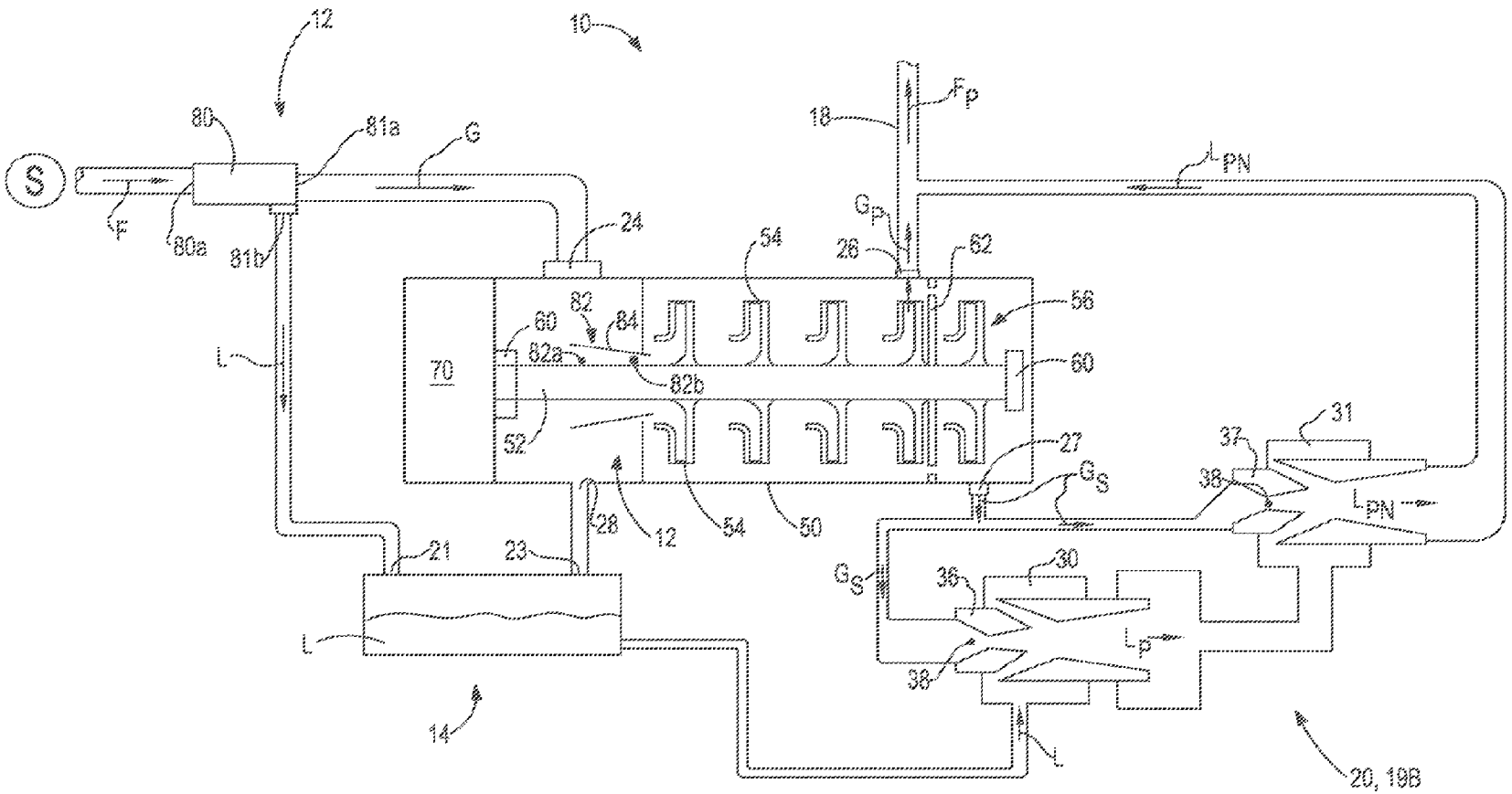
FIG. 2 is another schematic view of a fluid processing device according to one or more aspects of the present disclosure.

Referring now to the drawings in detail, there is shown in FIGS. 1-6 a fluid processing device 10, or compressor assembly, for processing a multiphase fluid stream. In an exemplary embodiment, the multiphase fluid stream may include a mixture of at least a gas and a liquid. An exemplary fluid processing device 10 may include at least one separator 12, a liquid reservoir 14, a compressor 16, a fluid discharge line 18 and at least one ejector pump 20. As illustrated in FIGS. 1-2, a source S of multiphase fluid F may be fluidly coupled to a separator 12 configured to separate the fluid stream F into a substantially liquid portion L and a substantially gaseous portion G. The liquid reservoir 14 may include an inlet 21 and an outlet 23, wherein the inlet 21 may be fluidly coupled with the separator 12 such that liquid L in the separator 12 flows into the reservoir 14. The compressor 16 may include an inlet 24 and an outlet 26, wherein the inlet 24 may also be fluidly coupled with the separator 12 so as to receive the substantially gaseous portion G. In exemplary operation, the compressor 16 is configured to pressurize the substantially gaseous portion G and subsequently discharge pressurized gas $G_P$ through the compressor outlet 26, which may be fluidly coupled to the fluid discharge line 18. Thus, the pressurized gas $G_P$ may flow into the discharge line 18.

In an exemplary embodiment, the ejector pump 20 may be fluidly coupled to both the compressor 16 and the liquid reservoir 14. For example, at least one ejector pump 20 may be configured to receive a portion $G_S$ of the pressurized gas $G_P$ from the compressor 16 which serves to draw in liquid from the liquid L reservoir 14. The ejector pump may then be configured to discharge pressurized liquid $L_P$ into the fluid discharge line 18. As can be appreciated, therefore, the pressurized liquid $L_P$ may include a combination pressurized stream of a portion $G_S$ of the pressurized gas $G_P$ and liquid L. The pressurized liquid $L_P$, then, may be configured to mix or combine with the pressurized gas $G_P$ exiting the compressor outlet 26 to form a pressurized multiphase fluid stream $F_P$.

Figure 3:
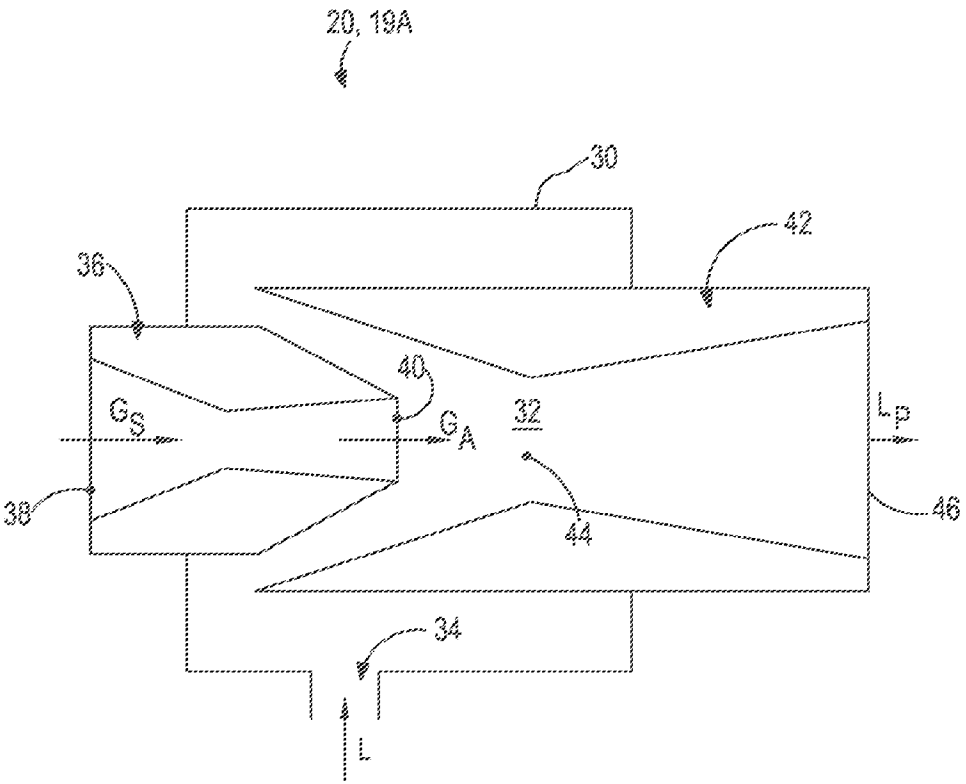
FIG. 3 is an enlarged, diagrammatic view of the exemplary single stage ejector pump shown in FIG. 1.
Figure 4:
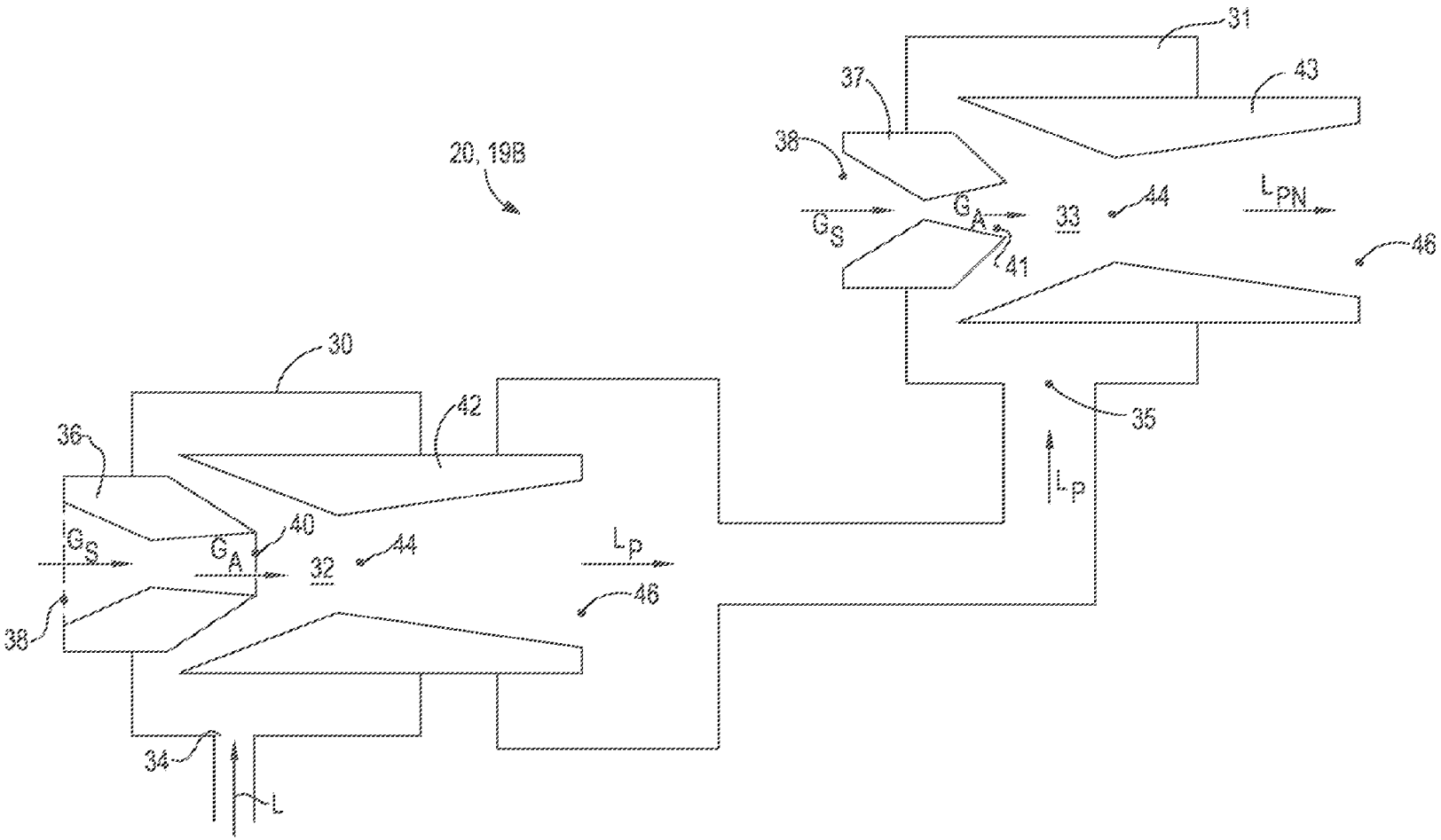
FIG. 4 is an enlarged, diagrammatic view of the multistage ejector pump shown in FIG. 2.

In an exemplary embodiment, the ejector pump 20 may be either a single stage ejector pump 19A, as detailed in FIGS. 1 and 3, or a multistage ejector pump 19B, as detailed in FIGS. 2 and 4. In some applications, the multistage ejector pump 19B may be referred to as a two-stage supersonic ejector pump.

Referring now to FIGS. 1-4, an exemplary ejector pump 20 may include an enclosure or housing 30 having an interior mixing chamber 32 and a suction inlet 34 configured to fluidly connect the fluid reservoir 14 with the mixing chamber 32. A nozzle 36 may be mounted to or within the housing 30 and may include an inlet 38 fluidly coupled to the compressor 16 and an outlet 40 fluidly coupled with the mixing chamber 32. In exemplary operation, the nozzle 36 may be configured to receive and accelerate the portion of the pressurized fluid $G_S$ derived from the compressor 16, thus producing an accelerated gas $G_A$ that is directed into the mixing chamber 32. As a result of the pressure differential thus created by the accelerated gas $G_A$, liquid L may thereby be drawn through the suction inlet 34 and into the mixing chamber 32 so as to mix with the accelerated gas $G_A$. The resulting mixture may include a mixed fluid stream consisting primarily of a liquid.

The ejector pump 20 may also include a diffuser 42 that is mounted to/within the housing 30. The diffuser may include an inlet 44 fluidly coupled with the mixing chamber 32 and an outlet 46. In exemplary operation, the diffuser 42 may be configured to pressurize the mixed fluid stream in the diffuser inlet 44 and thereby discharge a pressurized fluid stream $L_P$ through the diffuser outlet 46. In an exemplary embodiment, the diffuser outlet 46 may be fluidly coupled with either the discharge line 18 (see FIG. 1) or a second suction inlet 35 of a multistage ejector pump 19B, as described below (see FIGS. 2 and 4).

Referring now to the exemplary embodiment of FIGS. 2 and 4, the fluid processing device 10 may include a multistage ejector 19B, which may include a two-stage ejector pump, having a second housing 31 configured to enclose a second mixing chamber 33. The second housing 31 may include a second suction inlet 35 configured to fluidly couple the outlet 46 of the first diffuser 42 with the second mixing chamber 33. The two-stage ejector pump 19B may further include a second nozzle 37 having an inlet 38 fluidly coupled with the compressor 16 and configured to receive a portion $G_S$ of the pressurized gas $G_P$ from the compressor 16. The second nozzle 37 may further include an outlet 41 configured to fluidly couple the inlet 38 with the second mixing chamber 33. Also included in the two-stage ejector pump 19B may be a second diffuser 43 having an inlet 44 fluidly coupled with the second mixing chamber 33 and an outlet 46 fluidly coupled with the fluid discharge line 18 (see FIG. 2).

In exemplary operation, the second nozzle 37 may accelerate a portion $G_S$ of the pressurized gas $G_P$ derived from the compressor 16, thus generating an accelerated gas $G_A$ that is directed into the second mixing chamber 33. By accelerating the gas $G_A$ through the second nozzle 37, a pressure differential is thus created having the effect of drawing in the pressurized fluid stream LP from the first mixing chamber 32 through the second suction inlet 35 and into the second mixing chamber 33. Once in the second mixing chamber 33, the pressurized fluid stream $L_P$ from the first mixing chamber 32 may mix with the accelerated gas $G_A$ from the second nozzle 37. The second diffuser 43 may then be configured to pressurize the mixture generated in the second mixing chamber 33 and to discharge a new pressurized fluid stream $L_{PN}$ through the diffuser outlet 46. Thereafter, the new pressurized fluid stream $L_{PN}$ may combine or mix with the primary portion of the pressurized gas $G_P$ flowing out of the compressor outlet 26 and into the fluid discharge line 18, to form a pressurized multiphase fluid stream $F_P$ as discussed above.

According to one aspect of the present disclosure, the nozzles 36, 37 of each ejector 19A, 19B may be configured to accelerate the portion $G_S$ of pressurized gas $G_P$ derived from the compressor 16 to a supersonic velocity, which more efficiently draws in and pressurizes (i.e., "pumps") the fluid from the liquid reservoir 14. However, either nozzle 36, 37, or both in combination, may be configured to accelerate the portion $G_S$ of pressurized gas $G_P$ to only a subsonic velocity. As can be appreciated, using the disclosed embodiments herein may reduce or even eliminate the need for a separate motor or driver for the liquid reservoir 14.

Figure 5:
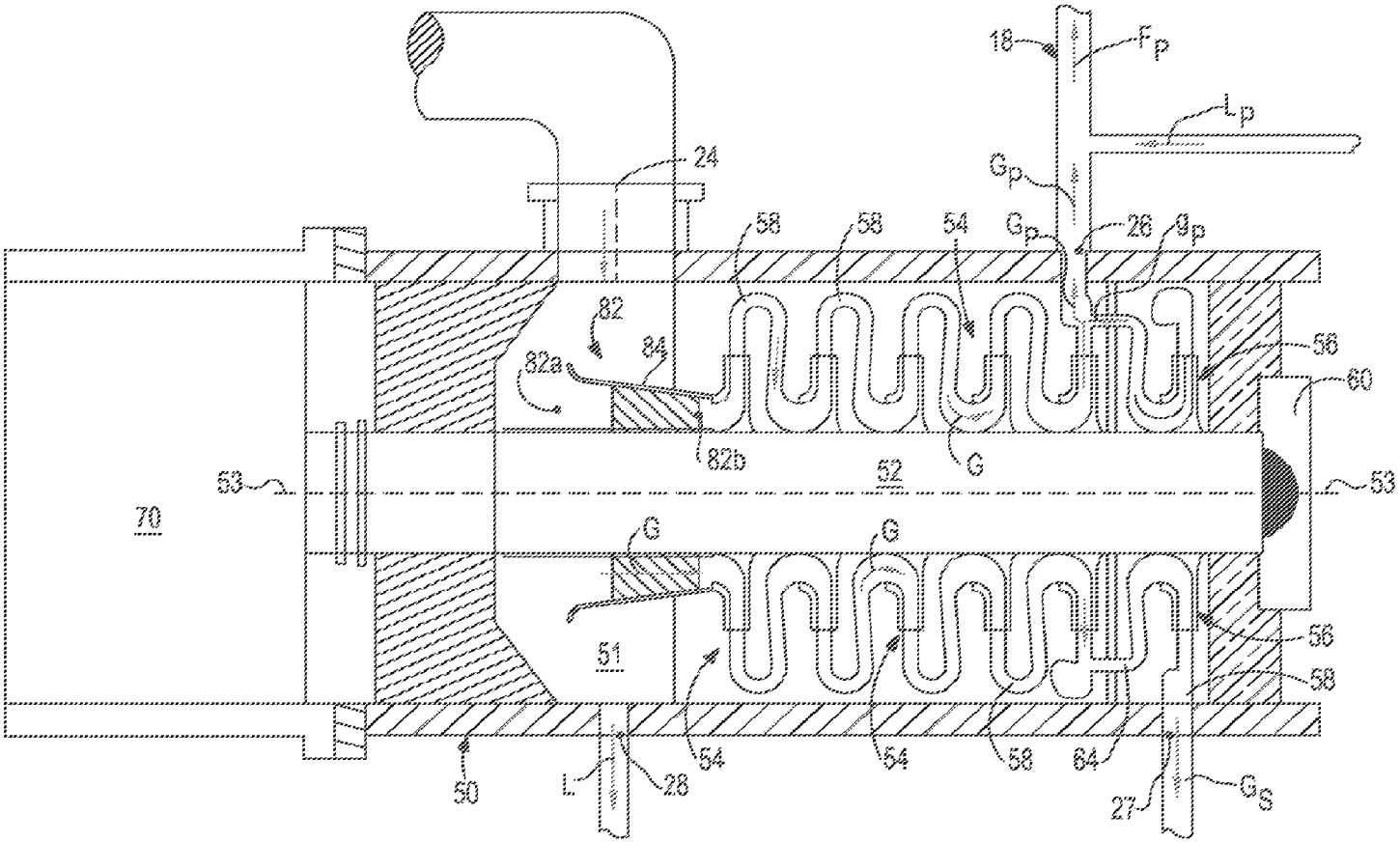
FIG. 5 is an enlarged, axial cross sectional view of a compressor according to one or more aspects of the present disclosure.
Figure 6:
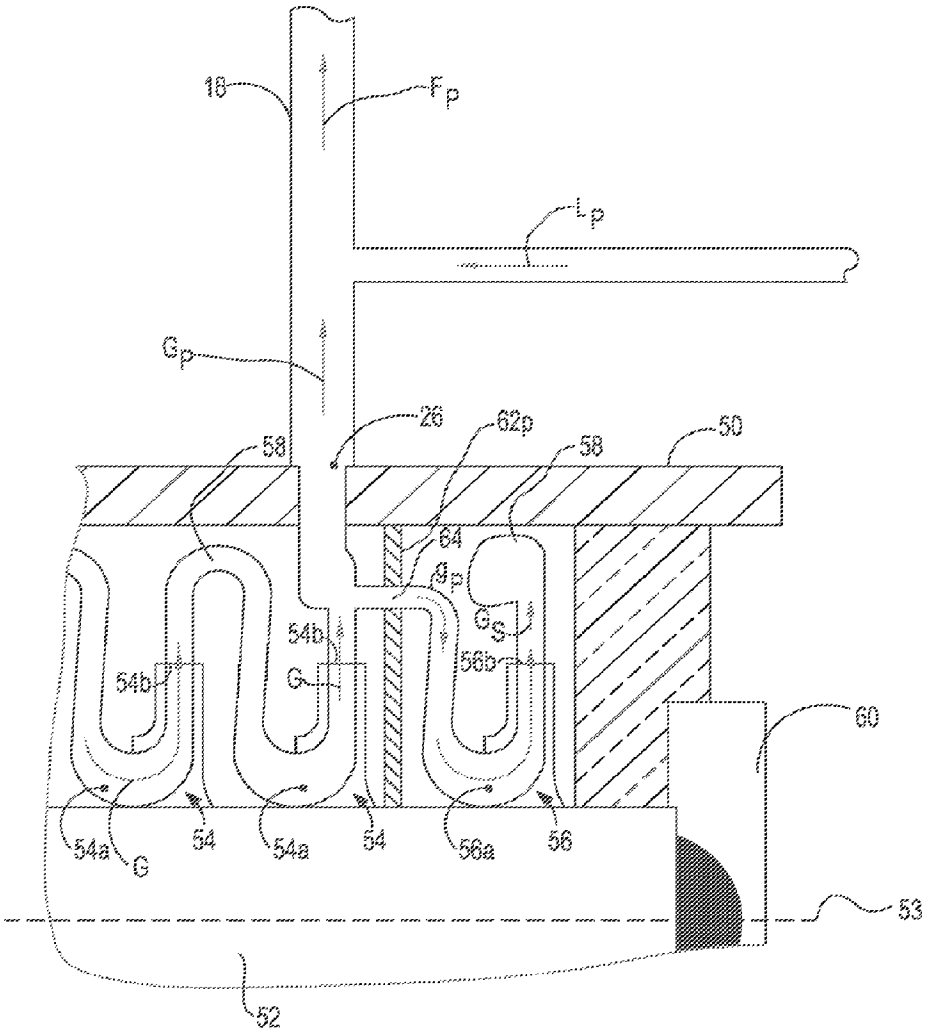
FIG. 6 is an enlarged view of a portion of the compressor shown in FIG. 5, showing details of a last stage primary impeller and a secondary impeller.

Referring now to FIGS. 1, 2, 5 and 6, an exemplary compressor 16 may include a casing 50, enclosing a shaft 52, one or more primary impellers 54, and one or more secondary or "boost" impellers 56. As illustrated in FIGS. 5 and 6, the casing 50 may also include a plurality of diffuser channels 58 disposed about and fluidly coupled with each impeller 54, 56. The casing 50 may have an interior chamber 51 (see FIG. 5) wherein the shaft 52 is rotatably disposed so as to extend generally central through the casing 50. In one embodiment, the shaft 52 may be rotatable about a central axis 53 and is supported at each end by two or more bearings or bearing assemblies 60.

The primary impellers 54 may be mounted on the shaft 52 and, as illustrated in FIG. 6, may each have an inlet 54*a* and an outlet 54*b*. In embodiments including more than one primary impeller 54, as illustrated, the primary impellers 54 may include "first stage" and "final stage" impellers 54, representing impellers 54 near the compressor inlet 24 and the compressor outlet 26, respectively. For example, the inlet 54*a* of a first stage impeller 54 may be fluidly coupled with the compressor inlet 24 and the outlet 54*b* of a final stage impeller 54 is fluidly coupled with the compressor outlet 26. Each primary impeller 54 may be configured to accelerate the gas G flowing into the inlet 54*a* such that an accelerated fluid passes from the impeller outlet 54*b* and into its associated diffuser 58, thus converting the velocity of the gas G into pressure. After the gas G passes through the one or more stages of the compressor 16 (i.e., each impeller 54 and associated diffuser channel 58), a pressurized gas $G_P$ may flow to the compressor outlet 26 at a desired outlet pressure. In an alternative embodiment, as can be appreciated, a single impeller 54 may serve as both first and final stage impeller 54, thus receiving and pressurizing the gas G, and discharging a pressurized gas $G_P$.

Further, the one or more boost impellers 56 (only one shown), also referred to as recycle impellers, may each be mounted on the shaft 52 adjacent the final stage primary impeller 54. In an exemplary embodiment, the boost impellers 56 may be radially smaller than the primary impellers 54, having an inlet 56*a* and an outlet 56*b*. The boost impeller inlet 56*a* may be fluidly coupled with the final stage impeller outlet 54*b* (i.e., through the diffuser 58 associated with the impeller 54) such that a portion $g_P$ of pressurized gas $G_P$ (see FIG. 6) flows into the first (or possibly the sole) boost impeller inlet 56*a*. In at least one embodiment, the secondary impeller outlet 56*b* may be fluidly coupled to an ejector pump 20 (see FIGS. 1 and 2) through a secondary outlet 27 of the compressor 16.

In an exemplary embodiment, the compressor 16 may further include a divider wall 62 disposed between the final stage primary impeller 54 and the first (or possibly the sole) boost impeller 56. As best shown in FIG. 6, the divider wall 62 may be penetrated by at least one diverter passage 64, which may fluidly connect the final stage primary impeller 54 to the first (or possibly the sole) boost impeller 56. More specifically, the diverter passage 64 may be fluidly coupled to the diffuser 58 of the last impeller 54 and may be sized such that only a portion $g_P$ of the pressurized gas $G_P$ flows to the boost impeller 56.

In exemplary operation, the boost impeller 56 may be configured to increase the pressure of the small portion $g_P$ of the pressurized gas $G_P$, thereby discharging the boosted pressurized gas $G_S$ into the ejector pump 20. Specifically, the inlet 38 of the ejector pump 20, 19A (see FIGS. 1 and 3) may be capable of receiving the boosted pressurized gas $G_S$ as it is fluidly coupled to the boost impeller outlet 56*b* through the secondary gas outlet 27. Likewise, in an alternative exemplary embodiment, the inlets 38 of the multiphase ejector pump 20, 19B (see FIGS. 2 and 4) may also be capable of receiving the boosted pressurized gas $G_S$ since they may also be fluidly coupled to the boost impeller outlet 56*b* through the secondary gas outlet 27.

In at least one embodiment, the boosted pressurized gas $G_S$ exiting the boost impeller 56 may be a "super-pressurized" gas, or a gas that is pressurized to a point generally greater than the pressure of the pressurized gas $G_P$ passing through the compressor outlet 26. To accomplish this, the secondary impellers 56 may be configured to increase pressure of the portion $g_P$ of the pressurized gas $G_P$ (FIG. 6) to a value that is between about fifty pounds per square inch (50 psi) and about one hundred pounds per square inch (100 psi) above the the pressure of the pressurized gas $G_P$ passing through the compressor outlet 26. However, as can be appreciated, the actual increase or difference in pressures may be other values as desired for any particular application of the fluid processing device 10. For example, in at least one embodiment, the difference in pressures between the boosted pressurized gas $G_S$ and the pressurized gas $G_P$ passing through the compressor outlet 26 need not be significant.

Referring now to FIGS. 1, 2 and 5, the exemplary separator 12 may include at least two distinct separators, a first "bulk" separator 80 and a second separator 82. Specifically, the first "bulk" separator 80 may have an inlet 80*a* fluidly coupled with the source S of multiphase fluid F, a gas outlet 81*a* fluidly coupled with the compressor inlet 24, and a liquid outlet 81*b* fluidly coupled with the liquid reservoir 14. In an exemplary embodiment, the bulk separator 80 may be configured to remove a substantial portion of the liquid L from the multiphase fluid F prior to the fluid F entering the compressor 16. Depending on the specific application, the bulk separator 80 may be constructed as a static separator, a rotary separator, or in any other appropriate manner as is known in the art.

The second separator 82 may be disposed within the compressor casing 50 having an inlet 82*a* fluidly coupled with the compressor inlet 24 and an outlet 82*b* fluidly coupled with the inlet 54*a* (see FIG. 6) of the first stage primary impeller 54. In exemplary operation, the second separator 82 may be configured to direct any remaining liquids in the substantially gaseous portion G generally toward a liquid outlet 28 of the compressor 16, wherein the liquid outlet 28 may be fluidly coupled with the liquid reservoir 14. In an exemplary embodiment, the second separator 82 may be a rotary separator that includes a separation drum 84 mounted to the compressor shaft 52. In alternative embodiments, the second separator 82 may be constructed as a static separator with appropriate separation channels and/or surfaces.

Still referring to FIGS. 1, 2 and 5, the fluid processing device 10 may further include a driver 70 operatively coupled to the shaft 52 and configured to rotate the shaft 52 about the central axis 53. Depending on the application, the driver 70 may include an electric motor, a hydraulic motor, an internal combustion engine, a gas turbine, or any other device capable of rotatably driving a shaft 52, either directly or through a power train.

In exemplary operation of the fluid processing device 10, a low pressure, multiphase fluid stream F may initially pass through the bulk separator 80 such that a majority of the liquid L is separated from the fluid stream F and channeled to the liquid reservoir 14. After separating the liquid L from the multiphase fluid stream F, the remaining substantially gaseous portion G may be channeled into the compressor 16 via the compressor inlet 24. Although having passed through the bulk separator 80, the substantially gaseous portion G may nonetheless contain traces of liquid L which may be removed by the second separator 82. Any liquid L retrieved through the second separator 82 may be channeled to the reservoir 14 via the liquid outlet 28.

The residual gas portion G may then flow through the one or more primary impellers 54 and associated diffusers 56 until the gas G attains a desired pressure of pressurized gas $G_P$. The majority of the pressurized gas $G_P$ may then be channeled from the last stage primary impeller 54, through the compressor outlet 26, and to the fluid discharge line 18. Meanwhile, a portion $g_P$ of the pressurized gas $G_P$ may be channeled through the diverter passage 64 and into the at least one secondary or boost impeller 56. In an exemplary embodiment, the boost impeller 56 may serve to increase the pressure of the portion $g_P$ of the pressurized gas $G_P$, thus generating a "super-pressurized" or boosted pressurized gas $G_S$. The boosted pressurized gas $G_S$ may then be channeled out of the compressor 16 via the secondary gas outlet 27 and to a single stage ejector pump 20, 19A (see FIGS. 1 and 3) that is fluidly coupled to the liquid reservoir 14.

As the boosted pressurized gas $G_S$ enters the nozzle 36 of the ejector 20, 19A, the gas $G_S$ may be accelerated to a point where liquid L is drawn into the ejector 20 from the liquid reservoir 14. Once entrained into the ejector 20, 19A, the liquid L is then mixed with the now accelerated gas $G_A$ to generate a pressurized stream $L_P$, formed primarily of liquid L. The pressurized stream $L_P$ may then be channeled from the ejector pump 20, 19A to the fluid discharge line 18, where it may be combined with the pressurized gas $G_P$ exiting the compressor outlet 26, thereby forming the desired pressurized multiphase fluid stream $F_P$.

In an alternative embodiment, the boosted pressurized gas $G_S$ may be channeled out of the compressor 16 via the secondary gas outlet 27 and to first and second nozzles 36, 37 of a multiphase ejector pump 20, 19B (see FIGS. 2 and 4). The first nozzle 36 may be fluidly coupled to the liquid reservoir 14, while the second nozzle 37 may be configured to receive and further process a pressurized stream $L_P$ generated, in part, through the first nozzle 36. In exemplary operation, boosted pressurized gas $G_S$ enters the first and second nozzles 36, 37 and is accelerated to generate an accelerated gas $G_A$. The accelerated gas $G_A$ in the first nozzle 36 may create a pressure differential serving to draw in liquid L from the liquid reservoir which then mixes with the accelerated gas $G_A$ to generate a pressurized stream $L_P$ formed primarily of liquid L. As a result of the pressure differential created in the second nozzle 37, the pressurized stream $L_P$ may then be drawn therein where it may be mixed with the accelerated gas $G_A$ from the second nozzle 37, resulting in a new pressurized fluid stream $L_{PN}$. The new pressurized fluid stream $L_{PN}$ may then be channeled to the discharge line 18 where it may combine or mix with the primary portion of the pressurized gas $G_P$ flowing out of the compressor outlet 26, thereby forming the desired pressurized multiphase fluid stream $F_P$.

The disclosed embodiments of the multiphase fluid processing device 10 may include a number of advantages over typical compressor assemblies, which in general use a conventional liquid pump (e.g., a centrifugal pump) to pressurize handle the separated liquid. As the secondary or boost impeller 56 is used to pressurize the small portion $g_P$ of the pressurized gas $G_P$ for the ejector pump 20, as opposed to a centrifugal pump for positively pumping liquid, the power necessary to drive the compressor 16 may be significantly reduced. Reducing the power requirement inherently results in a reduction in torque loading on the shaft 52. As such, the energy expenditure of the driver 70 is correspondingly reduced, increasing the efficiency of the compressor assembly 10. Further, wear on the shaft bearings 60 and other compressor components is reduced due to the lower torque requirements of the drive shaft 52.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A fluid processing device for processing a multiphase fluid stream having a mixture of at least a gas and a liquid, the fluid processing device comprising:

at least one separator configured to separate the multiphase fluid stream into a substantially liquid component and a substantially gaseous component;

a liquid reservoir having an inlet and an outlet, wherein the inlet is fluidly coupled to the at least one separator such that the substantially liquid component flows into the liquid reservoir;

a compressor having an inlet and an outlet, wherein the inlet of the compressor is fluidly coupled with an outlet of the at least one separator so as to receive and pressurize the substantially gaseous component, thereby discharging a pressurized gas through the outlet of the compressor;

an ejector pump fluidly coupled to both the compressor and the liquid reservoir, wherein the ejector pump receives at least some of the pressurized gas from the compressor to draw in a flow of the substantially liquid component from the liquid reservoir and to discharge a combined stream of liquid and pressurized gas; and a fluid discharge line fluidly coupled to the outlet of the compressor and configured to receive both the pressurized gas from the compressor and the combined stream of liquid and pressurized gas from the ejector pump, thereby forming a pressurized multiphase fluid stream.

2. The fluid processing device of claim 1, wherein the ejector pump is a single stage ejector pump or a multistage ejector pump.

3. The fluid processing device of claim 1, wherein the ejector pump comprises:

a housing having an interior mixing chamber and a suction inlet configured to fluidly connect the liquid reservoir to the interior mixing chamber;

a nozzle having an inlet fluidly coupled to the compressor and an outlet fluidly coupled to the interior mixing chamber, wherein the nozzle is configured to accelerate a flow of at least some of the pressurized gas from the compressor into the interior mixing chamber such that a flow of the substantially liquid component from the liquid reservoir is drawn through the suction inlet and into the interior mixing chamber, thereby mixing with the accelerated pressurized gas resulting in a mixed fluid stream; and a diffuser having an inlet fluidly coupled with the interior mixing chamber and an outlet fluidly coupled to the fluid discharge line, wherein the diffuser is configured to receive the mixed fluid stream and discharge the combined stream of liquid gas into the fluid discharge line.

4. The fluid processing device of claim 3, wherein the nozzle is configured to accelerate the flow of at least some of the pressurized gas from the compressor to at least a supersonic velocity.

5. The fluid processing device of claim 1, wherein the compressor further comprises:

a casing;

a shaft rotatably disposed within the casing;

first and second primary impellers mounted on the shaft, each having an inlet and an outlet, wherein the inlet of the first primary impeller is fluidly coupled to the inlet of the compressor and the outlet of the second primary impeller is fluidly coupled to the outlet of the compressor such that the pressurized gas flows to the compressor outlet; and a secondary impeller mounted on the shaft adjacent the second primary impeller and having an inlet fluidly coupled to the outlet of the compressor such that at least some of the pressurized gas flows from the outlet of the second primary impeller to the inlet of the secondary impeller, wherein the secondary the impeller is configured to increase the pressure of the pressurized gas entering the secondary impeller.

6. The fluid processing device of claim 5, wherein the secondary impeller further comprises an outlet fluidly coupled to the ejector pump, wherein the pressurized gas that enters the secondary impeller then exits the secondary impeller and is introduced to the ejector pump.

7. The fluid processing device of claim 6, wherein the ejector pump has at least one nozzle fluidly coupled to the outlet of the secondary impeller such that the at least some of the pressurized gas from the secondary impeller flows into the at least one nozzle.

8. The fluid processing device of claim 5, wherein the compressor further includes a divider wall disposed between the second primary impeller and the secondary impeller, and at least one diverter passage through the divider wall configured to fluidly connect the outlet of the second primary impeller with the inlet of the secondary impeller.

9. The fluid processing device of claim 5, wherein the secondary impeller is configured to increase the pressure of the pressurized gas flowing from the outlet of the second primary impeller by between about 50 psi and about 100 psi.

10. The fluid processing device of claim 5, further comprising a driver operatively coupled to the shaft and configured to rotate the shaft about a central axis.

11. The fluid processing device of claim 10, wherein the driver comprises an electric motor, a hydraulic motor, an internal combustion engine, a gas turbine, or a combination thereof.

12. The fluid processing device of claim 1, wherein the compressor comprises a casing providing the inlet and outlet of the compressor and at least one impeller disposed within the casing, and the at least one separator comprises:

a first separator having an inlet fluidly coupled to a fluid source and an outlet fluidly coupled with the inlet of the compressor; and a second separator disposed within the casing and having an inlet fluidly coupled to the inlet of the compressor and an outlet fluidly coupled to the at least one impeller.

13. The fluid processing device of claim 12, wherein the first separator is a static separator.

14. The fluid processing device of claim 13, wherein the second separator is a rotary separator.

15. A fluid processing device for processing a multiphase fluid stream having a mixture of at least a gas and a liquid, the fluid processing device comprising:

a first separator fluidly coupled to a multiphase fluid source and configured to separate the multiphase fluid stream into a substantially liquid component and a substantially gaseous component;

a liquid reservoir having an inlet and an outlet, wherein the inlet is fluidly coupled to the first separator such that the substantially liquid component flows into the liquid reservoir;

a compressor having an inlet and an outlet, wherein the inlet of the compressor is fluidly coupled to the first separator to receive the substantially gaseous component, the compressor being configured to pressurize the substantially gaseous component and discharge pressurized gas through the outlet of the compressor;

a first ejector pump fluidly coupled to both the compressor and the liquid reservoir, wherein the first ejector pump is configured to receive pressurized gas from the compressor to draw in a flow of the substantially liquid component from the liquid reservoir and to discharge a first pressurized liquid;

a second ejector pump fluidly coupled to both the compressor and the first ejector pump, wherein the second ejector pump is configured to receive pressurized gas from the compressor to draw in the first pressurized liquid from the first ejector pump and to discharge a second pressurized liquid; and a fluid discharge line fluidly coupled to the outlet of the compressor and configured to receive pressurized gas from the compressor and to receive the second pressurized liquid from the second ejector pump to provide a pressurized multiphase fluid stream.

16. The fluid processing device of claim 15, wherein the first ejector pump comprises:

a housing having a first interior mixing chamber and a suction inlet configured to fluidly connect the liquid reservoir to the first interior mixing chamber;

a nozzle having an inlet fluidly coupled to the compressor and an outlet fluidly coupled to the first interior mixing chamber, wherein the nozzle is configured to accelerate a first flow of pressurized gas from the compressor into the first interior mixing chamber such that a flow of the substantially liquid component from the liquid reservoir is drawn through the suction inlet and into the first interior mixing chamber, thereby mixing with the first flow of the pressurized gas to provide a first mixed fluid stream; and a diffuser having an inlet fluidly coupled to the first interior mixing chamber and an outlet fluidly coupled to the second ejector pump, wherein the diffuser is configured to receive the first mixed fluid stream and discharge the first pressurized liquid to the second ejector pump.

17. The fluid processing device of claim 16, wherein the second ejector pump comprises:

a housing having a second interior mixing chamber and a suction inlet configured to fluidly connect the first ejector pump to the second interior mixing chamber;

a nozzle having an inlet fluidly coupled to the compressor and an outlet fluidly coupled to the second interior mixing chamber, wherein the nozzle is configured to accelerate a second flow of the pressurized gas from the compressor into the second interior mixing chamber such that the first pressurized liquid from the first ejector pump is drawn through the suction inlet and into the second interior mixing chamber, thereby mixing with the second flow of the pressurized gas and resulting in a second mixed fluid stream; and a diffuser having an inlet fluidly coupled with the second interior mixing chamber and an outlet fluidly coupled to the fluid discharge line, wherein the diffuser is configured to receive the second mixed fluid stream and discharge the second pressurized liquid into the fluid discharge line.

18. The fluid processing device of claim 15, wherein the compressor further comprises:

a casing having a shaft rotatably disposed therein and providing the inlet and the outlet of the compressor;

at least one impeller mounted on the shaft and disposed within the casing; and a second separator disposed within the casing and having an inlet fluidly coupled to the inlet of the compressor and an outlet fluidly coupled to the at least one impeller.

19. The fluid processing device of claim 18, wherein the nozzle of the first ejector pump and the nozzle of the second ejector pump are each configured to accelerate a the pressurized gas from the compressor to a supersonic velocity.

20. A method of processing a multiphase fluid stream including a mixture of a gas and a liquid, comprising:

separating the multiphase fluid stream into a substantially liquid component and a substantially gaseous component using a first separator;

directing the substantially liquid component to a liquid reservoir fluidly coupled to the first separator;

pressurizing the substantially gaseous component in a compressor having an inlet and an outlet, wherein the inlet of the compressor is fluidly coupled to the first separator;

discharging a pressurized gas through the outlet of the compressor;

directing at least some of the pressurized gas from the compressor to an ejector pump fluidly coupled to both the compressor and the liquid reservoir;

drawing in a flow of the substantially liquid component from the liquid reservoir into the ejector pump;

discharging a pressurized liquid from the ejector pump; and receiving into a fluid discharge line both the pressurized gas from the compressor and the pressurized liquid from the ejector pump, wherein the fluid discharge line is fluidly coupled to both the compressor outlet and the ejector pump, to form a pressurized multiphase fluid stream.

21. The method of claim 20, wherein the compressor further comprises:

a casing having a shaft rotatably disposed therein, the casing providing the inlet and outlet of the compressor;

at least one impeller mounted on the shaft and disposed within the casing; and a second separator disposed within the casing and having an inlet fluidly coupled to the inlet of the compressor and an outlet fluidly coupled to the at least one impeller.

22. The method of claim 20, wherein the step of directing at least some of the pressurized gas from the compressor to the ejector pump further comprises:

directing at least some of the pressurized gas from the compressor to a secondary impeller having an inlet and an outlet;

increasing the pressure of the pressurized gas directed to the secondary impeller with the secondary impeller;

discharging the pressurized gas directed to the secondary impeller through the outlet of the secondary impeller and into the ejector pump.

23. The method of claim 22, wherein the ejector pump is a single stage ejector pump or a multistage ejector pump.

* * * * *